US005884537A

United States Patent [19]

Chen

[11] Patent Number: 5,884,537

[45] Date of Patent: Mar. 23, 1999

[54] RATCHET TOOL

[76] Inventor: Chun Chiung Chen, No. 45, Lane 25, Kuo Chung 1st Road, Da Li City, Taichung Hsien, Taiwan

[21] Appl. No.: 879,313

[22] Filed: Jun. 20, 1997

[51] Int. Cl.[6] ..... B25B 13/00

[52] U.S. Cl. ..... 81/58.4; 81/60; 192/54.2

[58] Field of Search ..... 81/58, 58.4, 60, 81/63.1, 59.1; 192/45.1, 54.2, 44, 45

[56] References Cited

U.S. PATENT DOCUMENTS

| | | | |
|---|---|---|---|
| 4,603,606 | 8/1986 | Headen . | |
| 4,669,339 | 6/1987 | Cartwright | 81/59.1 |
| 5,086,673 | 2/1992 | Korty | 81/59.1 |
| 5,425,291 | 6/1995 | Chang | 81/59.1 |
| 5,687,820 | 11/1997 | Lin | 192/43.2 |
| 5,752,590 | 5/1998 | Lin | 192/44 |

*Primary Examiner*—David A. Scherbel
*Assistant Examiner*—Dung Van Nguyen

[57] ABSTRACT

A ratchet tool includes a housing having an oval inner peripheral surface, and a core rotatably engaged in the housing for forming two curved slots between the housing and the core. The curved slots each includes two narrower end portions and a wider middle portion. Two pairs of wedges are slidably engaged in the curved slots and are biased to engage with the narrower ends for allowing the housing to drive the core. The wedges may be selectively moved toward the wider middle portions for allowing the housing to be rotated relative to the core in a reverse direction.

5 Claims, 3 Drawing Sheets

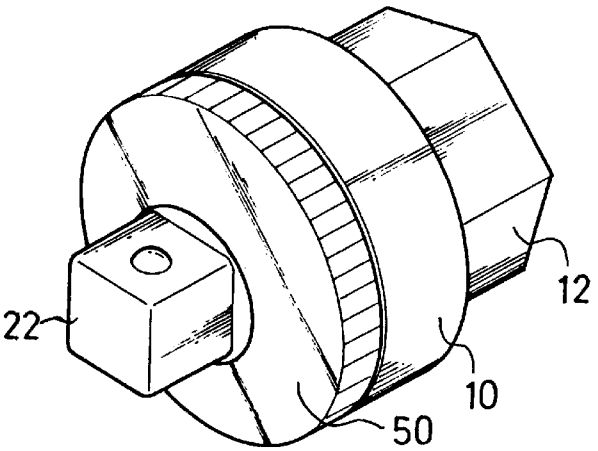
FIG. 2
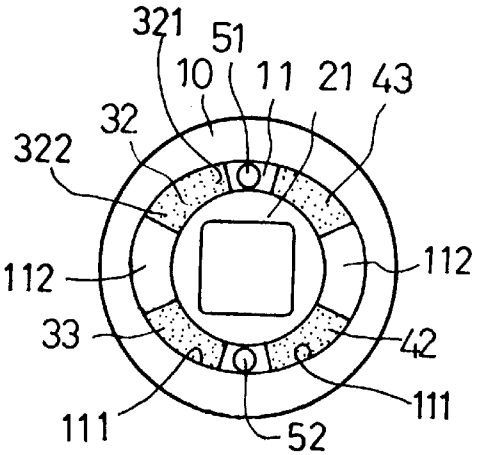
FIG. 3
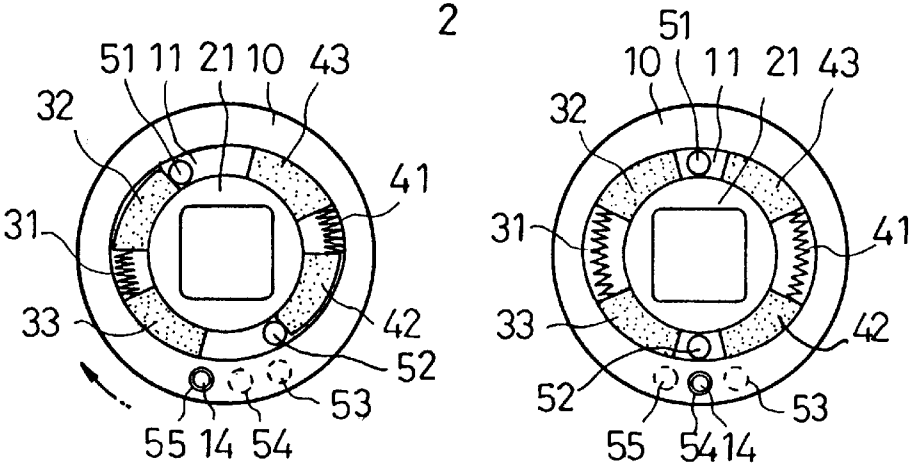
FIG. 4
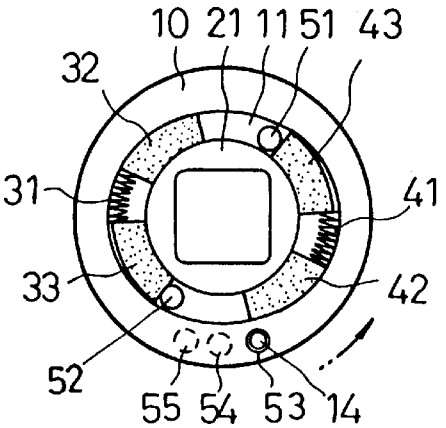
FIG. 6
FIG. 5

RATCHET TOOL

BACKGROUND OF THE INVENTION

1. Field of the Invention

The present invention relates to a tool, and more particularly to a ratchet tool.

2. Description of the Prior Art

A typical tool cartridge is disclosed in U.S. Pat. No. 4,603,606 to Headen and comprises a core rotatably received in a housing. The housing includes a number of ramps for engaging with roller bearings. However, it will be difficult to machine so many ramps in the housing such that the actuation of the roller bearings on the core may not be balanced.

The present invention has arisen to mitigate and/or obviate the afore-described disadvantages of the conventional ratchet tools.

SUMMARY OF THE INVENTION

The primary objective of the present invention is to provide a ratchet tool which includes a housing having an oval inner peripheral surface that may be easily machined or formed.

In accordance with one aspect of the invention, there is provided a ratchet tool comprising a housing including an interior defined by an oval inner peripheral surface, a core rotatably engaged in the interior of the housing and including a circular outer peripheral surface and including a driving shaft extended outward of the housing, the oval inner peripheral surface of the housing and the circular outer peripheral surface of the core forming two curved slots each having two narrower end portions and a wider middle portion, two pairs of engaging members slidably engaged in the curved slots, means for biasing the engaging members to engage with the narrower ends of the curved slots and for allowing the housing to drive and to rotate the core in an active direction, and means for selectively moving the engaging members toward the wider middle portions of the curved slots and for allowing the housing to be rotated relative to the core in a reverse direction.

The engaging members are wedges and each includes a thinner end for engaging with the narrower end portion of the curved slot and each includes a thicker end for engaging with the wider middle portion of the curved slot, the biasing means is provided for biasing the thinner ends of the wedges to engage with the narrower ends of the curved slots and for allowing the housing to drive and to rotate the core in the active direction. The wedges each includes a knurled inner surface for engaging with the circular outer peripheral surface of the core.

The selectively moving means includes a cover rotatably secured to the housing, the cover includes two poles extended into the curved slots and engaged between the wedges for moving the wedges toward the wider middle portions of the curved slots when the cover is rotated relative to the housing. A positioning means includes three depressions formed in the cover, and includes a spring biased projection provided in the housing for engaging with the depressions of the cover and for positioning the cover relative to the housing.

Further objectives and advantages of the present invention will become apparent from a careful reading of a detailed description provided hereinbelow, with appropriate reference to accompanying drawings.

BRIEF DESCRIPTION OF THE DRAWINGS

FIG. 2 is a bottom perspective view of the ratchet tool;

FIG. 3 is a schematic view illustrating the engagement of the core within the housing;

FIGS. 4, 5, 6 are schematic views similar to FIG. 3, illustrating the operation of the ratchet tool;

DETAILED DESCRIPTION OF THE PREFERRED EMBODIMENT

Figure 1:
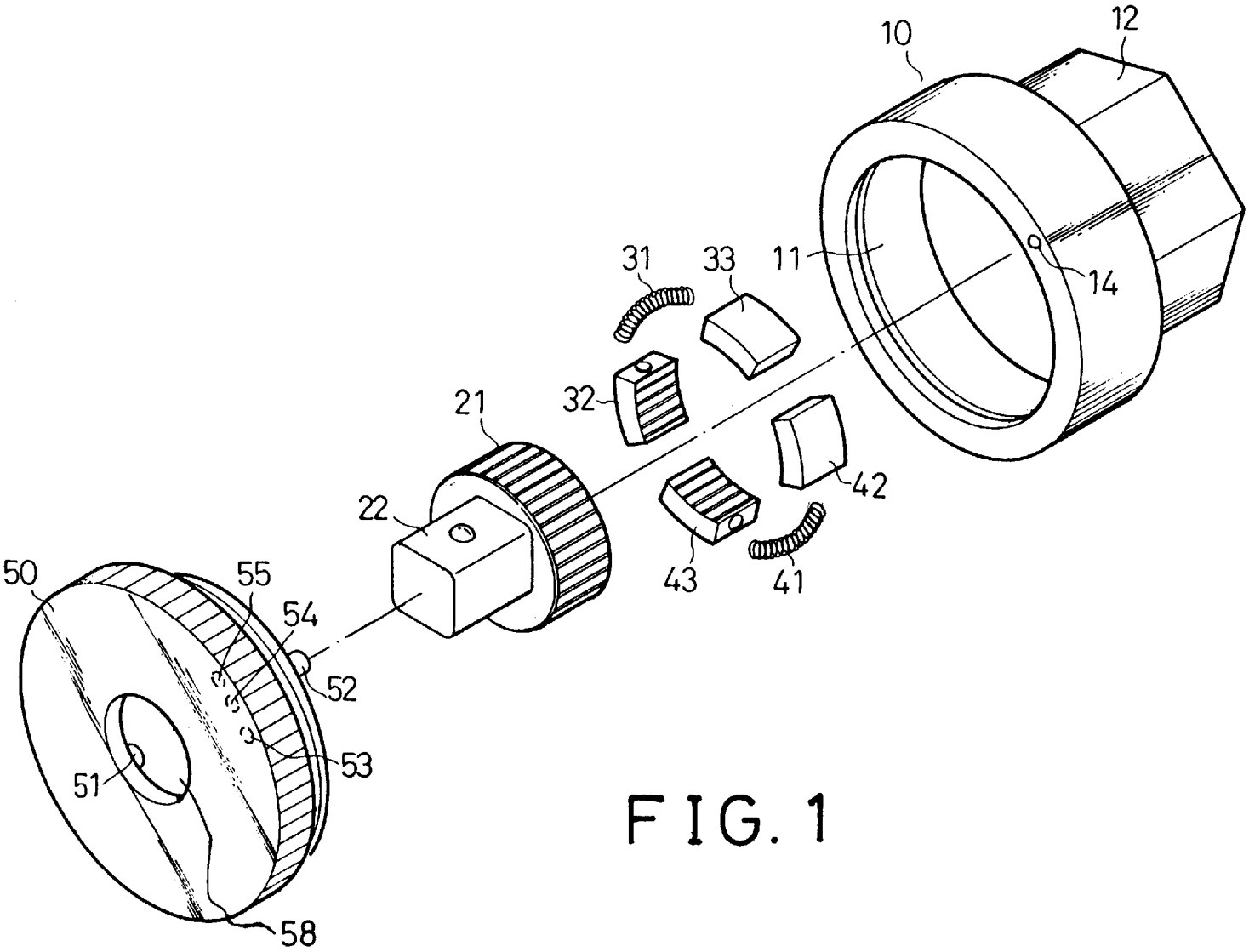
FIG. 1 is an exploded view of a ratchet tool in accordance with the present invention.
Figure 7:
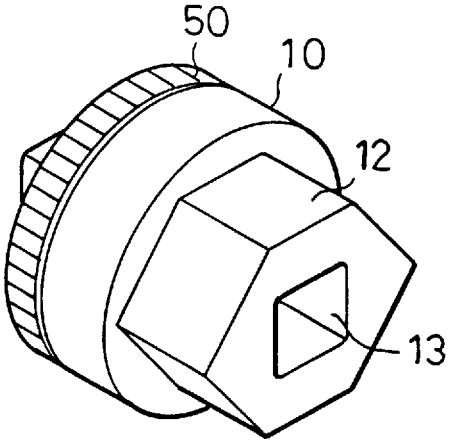
FIG. 7 is an upper perspective view of the ratchet tool.

Referring to the drawings, and initially to FIGS. 1–3, a ratchet tool in accordance with the present invention comprises a housing 10 including an interior defined by an oval inner peripheral surface 11, best shown in FIG. 3. A core 21 is rotatably engaged in the interior of the housing 10 and includes a circular cross section (FIG. 3) and includes a driving shaft 22 extended through the orifice 58 of the cover 50. As best shown in FIG. 3, the oval inner peripheral surface 11 of the housing 10 and the circular outer peripheral surface of the core 21 form two curved slots each having two narrower end portions 111 and a wider middle portion 112. Two pairs of engaging members, such as wedges 32, 33, 42, 43 are slidably engaged in the curved slots and each includes a thinner end 321 for engaging with the narrower end portion 111 of the curved slots and each includes a thicker end 322 for engaging with the wider middle portion 112 of the curved slots. Two springs 31, 41 are engaged in the wider middle portions 112 and are engaged between the wedges 32, 33; 42, 43 of the respective pair of wedges (FIGS. 4–6) for biasing the thinner ends 321 of the wedges 32, 33, 42, 43 to engage with the narrower ends of the curved slots.

The cover 50 includes two poles 51, 52 extended into the curved slots and engaged between the wedges 32, 43; and 33, 42 (FIGS. 3–6) for engaging with and for moving the wedges 32, 33, 42, 43 toward the wider middle portions 112 of the curved slots when the cover 50 is rotated relative to the housing 10. The housing 10 includes a spring biased projection 14 for engaging with either of three depressions 53, 54, 55 of the cover 50 and for positioning the cover 50 relative to the housing 10 and for positioning the poles 51, 52 relative to the wedges 32, 33, 42, 43. Alternatively, the projection 14 may be provided in the cover 50 for engaging with either of three depressions formed in the housing 10 and for positioning the cover relative to the housing.

In operation, as shown in FIG. 4, when the cover 50 is not rotated relative to the housing 10 and when the poles 51, 52 are not engaged with the wedges 32, 33, 42, 43, the springs 31, 41 may bias the wedges 32, 33, 42, 43 to engage with the narrower ends 111 of the curved slots. At this moment, the core 21 may be rotated clockwise and counterclockwise by the housing 10. At this moment, the projection 14 may engage with the middle depression 54 so as to position the cover 50 relative to the housing 10.

As shown in FIG. 5, when the wedges 32, 42 are moved toward the wider middle portions 112 of the curved slots against the springs 31, 41 by the poles 51, 52, the core 21 may be driven clockwise by the housing 10. At this moment, the projection 14 may engage with a side depression 55 so as to position the cover 50 relative to the housing 10.

As shown in FIG. 6, when the wedges 33, 43 are moved toward the wider middle portions 112 of the curved slots against the springs 31, 41 by the poles 51, 52, the core 21 may be driven counterclockwise by the housing 10. At this moment, the projection 14 may engage with the other side depression 53 so as to position the cover 50 relative to the housing 10.

Figure 8:
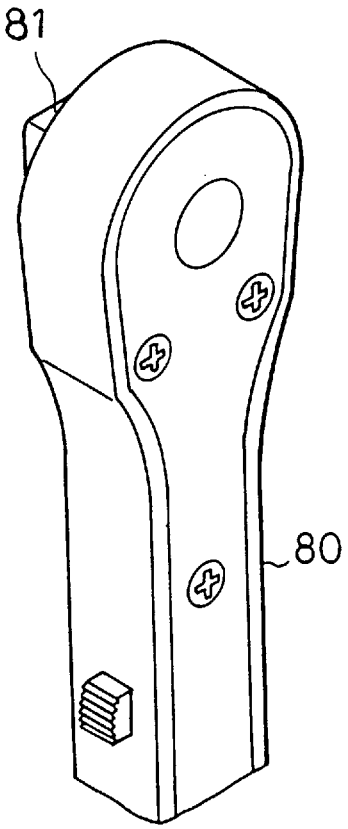
FIG. 8 PRIOR ART
FIGS. 8 and 9 are perspective views illustrating two typical wrenches that may be engaged with the ratchet tool in accordance with the present invention.
Figure 9:
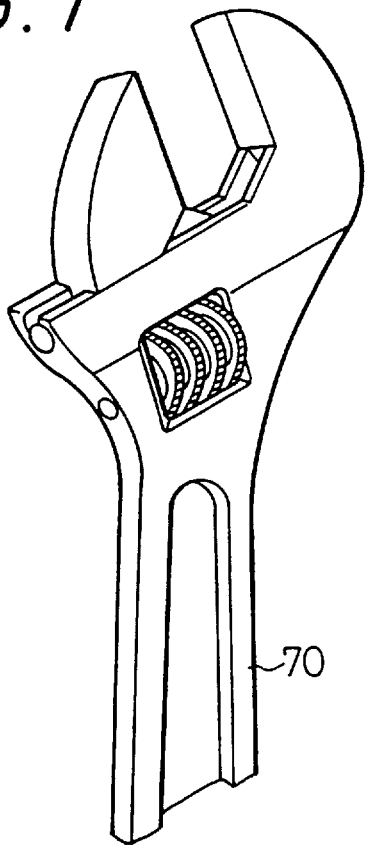
FIG. 9 PRIOR ART

The housing 10 includes a stem 12 extended upward for engaging with a typical wrench 70 (FIG. 9) and for allowing the typical wrench 70 to drive and to rotate the housing 10. The stem 12 may also includes an engaging hole 13 for engaging with a driving stem 81 of another typical tool 80 (FIG. 8) and for allowing the typical wrench 80 to drive and to rotate the housing 10. The housing 10 includes an open bottom for engaging with a cover 50 which is rotatably secured to the housing 10, by such as retaining ring. The cover 50 includes an orifice 58. The housing 10 may also be formed as a driving head that is formed integral on one end of a handle so as to form a ratchet driving mechanism for a tool.

It is to be noted that the housing 10 includes an oval inner peripheral surface which may be easily machined or formed, as compared with the number of ramps of the typical ratchet tools. In addition, the wedges 32, 33, 42, 43 are in surface contact with the oval inner peripheral surface 11 of the housing 10 and with the outer peripheral surface of the core 21 such that the wedges 32, 33, 42, 43 will not be easily damaged. The outer peripheral surface of the core 21 and the inner surfaces of the wedges 32, 33, 42, 43 for engaging with the core 21 are preferably knurled for facilitating the engagement between the contact surfaces. Alternatively, two pairs of balls or rollers may also be biased to engage with the narrower ends of the curved slots and may also be used to control the rotational directions of the ratchet tool.

Accordingly, the ratchet tool in accordance with the present invention includes a housing having an oval inner peripheral surface that may be easily machined or formed, and includes two pairs of wedges for increasing the contact surfaces between the housing and the core and for increasing the working life of the ratchet tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet tool comprising:

a housing including an interior defined by an oval inner peripheral surface, a core rotatably engaged in said interior of said housing and including a circular outer peripheral surface and including a driving shaft extended outward of said housing, said oval inner peripheral surface of said housing and said circular outer peripheral surface of said core forming two curved slots each having two narrower end portions and a wider middle portion, two pairs of engaging members slidably engaged in said curved slots, means for biasing said engaging members to engage with said narrower ends of said curved slots and for allowing said housing to drive and to rotate said core in an active direction, and means for selectively moving said engaging members toward said wider middle portions of said curved slots and for allowing said housing to be rotated relative to said core in a reverse direction, said engaging members being wedges and each including a thinner end for engaging with said narrower end portion of said curved slot and each including a thicker end for engaging with said wider middle portion of said curved slot, said biasing means being provided for biasing said thinner ends of said wedges to engage with said narrower ends of said curved slots and for allowing said housing to drive and to rotate said core in the active direction.

2. A ratchet tool according to claim 1, wherein said wedges each includes a knurled inner surface for engaging with said circular outer peripheral surface of said core.

3. A ratchet tool according to claim 1, wherein said selectively moving means includes a cover rotatably secured to said housing, said cover includes two poles extended into said curved slots and engaged between said wedges for moving said wedges toward said wider middle portions of said curved slots when said cover is rotated relative to said housing.

4. A ratchet tool according to claim 3 further comprising means for positioning said cover to said housing.

5. A ratchet tool according to claim 4, wherein positioning means includes three depressions formed in said cover, and includes a spring biased projection provided in said housing for engaging with said depressions of said cover and for positioning said cover relative to said housing.

* * * * *